US006847266B2

(12) United States Patent
Laney et al.

(10) Patent No.: US 6,847,266 B2
(45) Date of Patent: Jan. 25, 2005

(54) MICROELECTROMECHANICAL RF AND MICROWAVE FREQUENCY POWER REGULATOR

(75) Inventors: David Laney, La Jolla, CA (US); Mehran Matloubian, Encino, CA (US); Lawrence Larson, Del Mar, CA (US)

(73) Assignee: HRL Laboratories, LLC, Malibu, CA (US)

( * ) Notice: Subject to any disclaimer, the term of this patent is extended or adjusted under 35 U.S.C. 154(b) by 0 days.

(21) Appl. No.: 10/337,967

(22) Filed: Jan. 6, 2003

(65) Prior Publication Data

US 2003/0222728 A1 Dec. 4, 2003

Related U.S. Application Data

(62) Division of application No. 09/431,308, filed on Oct. 30, 1999, now Pat. No. 6,504,447.

(51) Int. Cl.[7] ..... H01P 1/24
(52) U.S. Cl. ..... 333/12; 333/262
(58) Field of Search ..... 333/17.2, 101, 333/105, 262, 12; 200/181; 361/56

(56) References Cited

U.S. PATENT DOCUMENTS

| | | | | |
|---|---|---|---|---|
| 5,619,061 A | | 4/1997 | Goldsmith et al. | |
| 5,638,946 A | | 6/1997 | Zavracky | |
| 5,946,176 A | * | 8/1999 | Ghoshal | 361/56 |
| 6,020,564 A | | 2/2000 | Wang et al. | |
| 6,058,229 A | | 5/2000 | Burrows et al. | |
| 6,100,477 A | | 8/2000 | Randall et al. | |
| 6,133,807 A | | 10/2000 | Akiyama et al. | |
| 6,143,997 A | | 11/2000 | Feng et al. | |
| 6,188,301 B1 | | 2/2001 | Kornrumpf et al. | |
| 6,239,685 B1 | | 5/2001 | Albrecht et al. | |

OTHER PUBLICATIONS

R. Holtzman, "Numerical Analysis Predicts PIN–Diode Limiter Performance", Jun. 1995, Microwaves & RF, pp. 82–85.

P. Sahjani and E. Higham, "PIN Diode Limiters Handle High–Power Input Signals", Apr. 1990, Microwaves & RF, pp. 195–199.

T. Parra, JM. Dienot, M. Gayral, M. Pouysegur, JP. Sautereau, and J. Graffeuil, "X–Band Low Phase Distortion MMIC Power Limiter," IEEE Transactions on Microwave Theory and Techniques, vol. 41, No. 5, May 1993, pp. 876–879.

(List continued on next page.)

*Primary Examiner*—Robert Pascal
*Assistant Examiner*—Dean Takaoka
(74) *Attorney, Agent, or Firm*—Tope-McKay & Associates

(57) ABSTRACT

Microelectromechanical RF and microwave frequency power limiter and electrostatic protection devices for use in high-speed circuits are presented. The devices utilize an airbridge or a cantilever arm including a contact pad positioned operatively adjacent to an electrically conductive and substantially planar transmission line. When the power level in the transmission line exceeds a particular threshold, the airbridge or cantilever arm yields due to force between the contact pad and the transmission line, directing undesired power away from active devices. This characteristic can either serve as a method by which to limit the amount of power passing through the transmission line to a determined value or as a method by which to protect devices along the transmission line from damage due to large electrostatic bursts.

9 Claims, 6 Drawing Sheets

OTHER PUBLICATIONS

D.J. Saymour, D.D. Heston, R.E. Lehmann, and D. Zych, "X–Band Monolithic GaAs Pin Diode Variable Attenuation Limiter," 1990 IEEE MTT–S Digest, pp. 841–844.

C. Trantanella, M. Pollman, and M. Shifrin, "An Investigation of GaAs MMIC High Power Limiters for Circuit Protection," 1997 IEEE MTT–S Digest.

C. Goldsmith, J. Randall, S. eShelman, T.H. Lin, D. Denniston, S. Chen, B. Norvell, "Characteristics of Micromachined Switches at Microwave Frequencies," 1996 IEEE MTT–S Digest, pp. 1141–1144.

H.J. De Los Santos, Y. Kao, A.L. Caigoy, and E.D. Ditmars, "Microwave and Mechanical Considerations in the Design of MEM Switches for Aerospace Applications," 1997 IEEE, pp. 235–253.

M. Hagio, K. Kanazawa, S. Nambu, S. Tohmori, and S. Ogata, "Monolithic Integration of Surge Protection Diodes into Low–Noise GaAs MESFETs," IEEE Transactions on Electron Devices, vol. ED–32, No. 5, May 1985, pp. 892–895.

K. Bock, "ESD issues in compound semiconductor high–frequency devices and circuits," Microelectronics Reliability 38 (1998), pp. 1781–1793.

M. Mehregany, "An Overview of Microelectromechanical Systems," SPIE, vol. 1793, Integrated Optics and Microstructures (1992), pp. 2–11.

G. Croft and J. Bernier, "ESD protection techniques for high frequency integrated circuits," Microelectronics Reliability 38 (1998) pp. 1681–1689.

* cited by examiner

MICROELECTROMECHANICAL RF AND MICROWAVE FREQUENCY POWER REGULATOR

PRIORITY CLAIM

This application is a divisional application claiming priority to U.S. patent application Ser. No. 09/431,308, filed Oct. 30, 1999 now U.S. Pat. No. 6,504,447, issued on Jan. 7, 2003, and titled "Microelectromechanical RF and Microwave Frequency Power Regulator."

TECHNICAL FIELD

The present invention discloses an effective technique to provide overload and electrostatic discharge (ESD) protection to microwave/millimeter wave monolithic integrated circuits (MMICs) including low noise amplifiers (LNAs) using a microelectromechanical (MEM) device.

BACKGROUND OF THE INVENTION

In the construction of MMICs, power regulation and, more specifically, power limiting and ESD protection are desirable to prevent device bum-out from high incident RF power.

PIN diodes are typically used as power limiters, but these diodes are lossy (~1.0 dB) at millimeter wave frequencies. Not only does the loss due to an input power limiter reduce the input signal level and thus the required amplification to reach a specified output level, but also reduces the signal-to-noise ratio by increasing the system's noise figure. Any loss due to a power limiter adds directly to the noise figure of the amplifier. Furthermore, diodes are difficult to use, as they require impedance matching with the circuitry to which they are connected, tending to reduce the available bandwidth. PIN diodes are also not generally available in low-noise, high electron mobility transistor (HEMT) processes and thus cannot be integrated onto the same substrate as the rest of the MMIC.

Semiconductor devices are sensitive to excessive input voltages, such as those generated by ESD. High-speed devices are particularly sensitive. MMIC systems that encounter ESD typically suffer from either immediate or latent component failure. In low frequency applications, the most common technique for protecting input, output, and power pins from damage is to include ESD diodes to shunt the undesired input signal away from the active devices and a series resistor to allow for sufficient time for the diodes to turn on. However, ESD diodes tend to have a large capacitance at high frequencies, which limits their use in radio to millimeter frequency applications. Additionally, a series resistor is not acceptable in a MIMIC system due to the incurred loss which, in order to compensate, would require greater input power. The result of these shortcomings in diodes and resistors leave the typical high-speed devices that operate at RF frequencies and above unprotected.

The present invention overcomes many of the difficulties involved in the use of diodes as power limiters and the use of diodes as ESD protection devices. These devices utilize the strong electromagnetic field associated with the high power signal or an ESD event to short out harmful signals and to protect the remainder of the MMIC system. These devices are each considered in two preferred aspects; a flexible bridge cantilever anchored at both ends supporting an electrical contact over a transmission line and as a cantilever anchored at one end with at least one contact at or near the opposite end.

SUMMARY OF THE INVENTION

The present invention is directed to a microelectromechanical RF and microwave frequency power regulator that may be tailored to a variety of applications including uses such as power limiting and electrostatic discharge protection for semiconductor devices. The power regulator includes a substrate on which at least one electrically conductive ground contact and a substantially planar transmission line are formed. A substantially elongated, electrically conductive strip is connected to the at least one ground contact and is positioned so that a portion of the substantially elongated strip is adjacent to the transmission line and so that a gap is formed therebetween. The electrically conductive strip may be formed in shapes such as a bridge or a cantilever arm, or may take other forms, as suitable to a particular application. In operation, when an undesirable signal is present on the transmission line, the resultant force created causes the conductive strip to flex toward, and physically contact the transmission line. Thus, the undesirable signal is diverted away from the circuit being protected by passing the signal through the conductive strip to ground.

This invention has been reduced to practice in the form of a power limiter and as an electrostatic device protection unit, and has various other applications that will be evident to those skilled in the art.

DETAILED DESCRIPTION

The power regulator of the present invention is useful to regulate power in microwave and millimeter wave circuits, and may be tailored to a variety of applications. The proposed power regulator has been reduced to practice in the context of two specific applications, a power limiter and an electrostatic discharge (ESD) protection unit. In both applications, the device has been utilized in both a flexible cantilever and as a bridge, as described in greater detail in the paragraphs that follow. This description will first detail the cantilever and bridge as examples of aspects of the present invention and will then proceed to detail specific applications of the present invention. These examples of aspects are presented for illustration of this invention, and are not to be considered limitations to its scope.

The present invention relates to power regulators such as power limiters and ESD protection units, as well as to apparatus incorporating them therein. The following description is presented to enable one of ordinary skill in the art to make and use the invention and to incorporate it in the context of particular applications. Various modifications to the preferred aspect, as well as a variety of uses in different applications will be readily apparent to those skilled in the art, and the general principles defined herein may be applied to other aspects. Thus, the present invention is not intended to be limited to the aspects shown, but is to be accorded the widest scope consistent with the principles and novel features disclosed herein.

Figure 1:
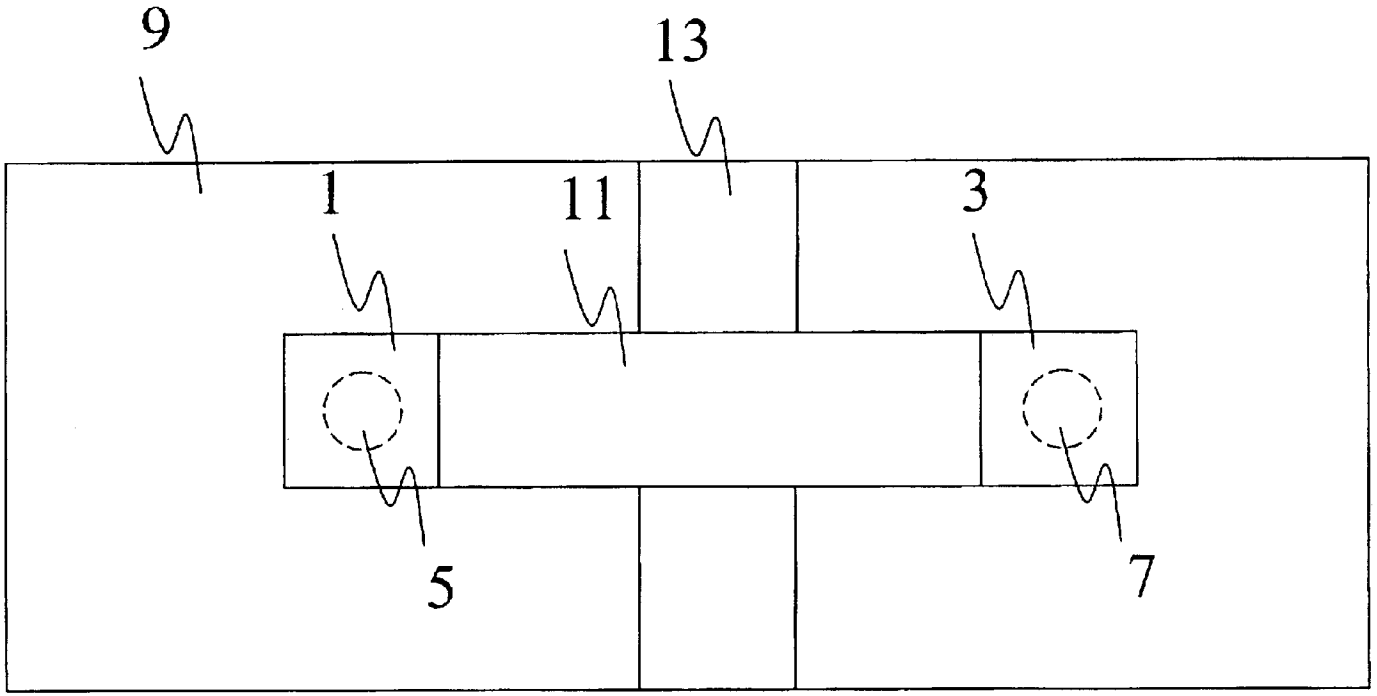
FIG. 1 is a top view of a shunt bridge aspect of the device of the present invention.

A top view of a bridge aspect of the device of the present invention is shown in FIG. 1. This aspect includes a substrate 9 with ground contacts 1 and 3 formed thereon. An example of a typical substrate material is semi-insulating GaAs with Au as a contact metal, although other material families may be appropriate depending on the particular application. The ground contacts 1 and 3 are electrically connected, through via holes 5 and 7, respectively, to a metallization layer 15 (see FIGS. 2 and 3) formed on the bottom side of a substrate 9. The electrically connected via holes 5 and 7 are created by selectively etching holes through the substrate to the top metal layers, 1 and 3. The sidewalls of the holes are then plated, making contact with the metallization layer 15. A substantially elongated strip of electrically conductive material in the form of a bridge 11 is designed such that it traverses an electrically conductive transmission line 13 forming an air gap 16 (see FIG. 2) between the bridge 11 and the electrically conductive transmission line 13. On top of the metal conductive bridge is a spring material such as silicon nitride, which causes the bridge to return to its normally "open" position after an ESD event or the high power signal has subsided.

Figure 2:
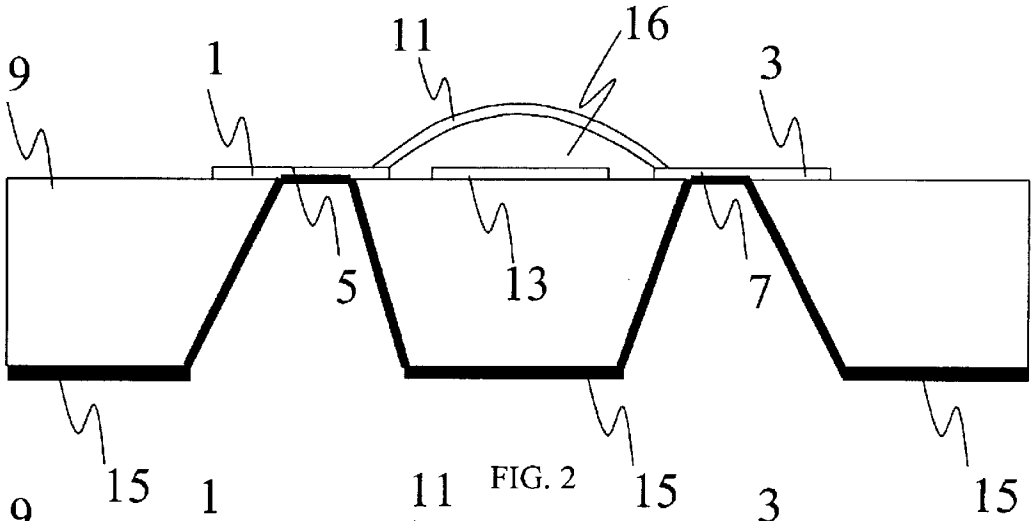
FIG. 2 is a side view of a shunt bridge aspect of the device of the present invention, demonstrating the airbridge in the "open" position.
Figure 3:
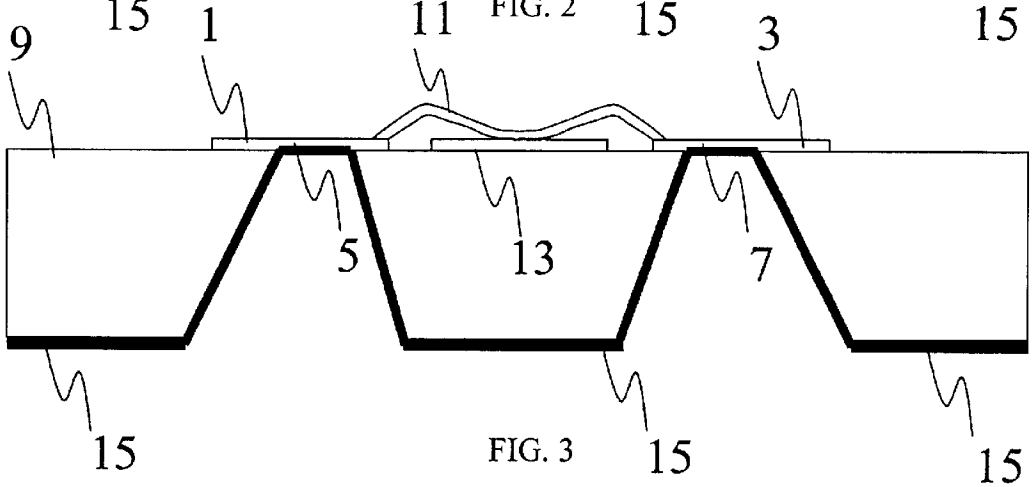
FIG. 3 is a side view of a shunt bridge aspect of the device of the present invention, demonstrating the airbridge in the "closed" configuration.

FIGS. 2 and 3 demonstrate the bridge power regulator during operation in the "open" and "closed" positions, respectively, with parts 1, 3, 5, 7, 9, 11, and 13 corresponding to the same in FIG. 1. In FIG. 2, there exists a gap 16 between the bridge 11 and the electrically conductive transmission line 13. This state occurs during normal operation when there are no signals of sufficient power to activate the power regulator.

FIG. 3 shows the power regulator's response to an undesired signal passing along the planar transmission line 13. The air bridge 11, in this case, will flex to cause an electrical connection with the transmission line 13, thereby directing the unwanted signal through the ground contacts 1 and 3 and the via holes 5 and 7 to the metallization layer 15. Flexing of the bridge is caused by an attractive force developed between the bridge and the transmission line due to charges induced by the signal on the bridge 11. When the signal is of sufficient strength to induce sufficient charges on the bridge 11 to cause a force sufficient to overcome its mechanical tension, the bridge 11 collapses thereby making contact to the transmission line 13. A DC bias may be applied to metallization layer 15 in order to change the signal required on the transmission line 13 to activate the device. This provides a means for threshold adjustment. Rather than, or in addition to, a DC bias, a material such as an electret may be used to build-in some static charge on the metallization layer 15 also reducing the required signal on the transmission line 13 for activation. Care must be takes so as to prevent excessive built-in charge to ensure the device will return to the "open" position once the undesired signal has subsided.

Although FIGS. 1, 2, and 3 present an aspect utilizing a microstrip transmission line 13 requiring via holes 5 and 7, other circuit configurations such as those utilizing coplanar transmission lines may not require via holes and their accompanying electrical paths. Thus the present invention is adaptable to a variety of substrates in a variety of configurations.

Figure 4:
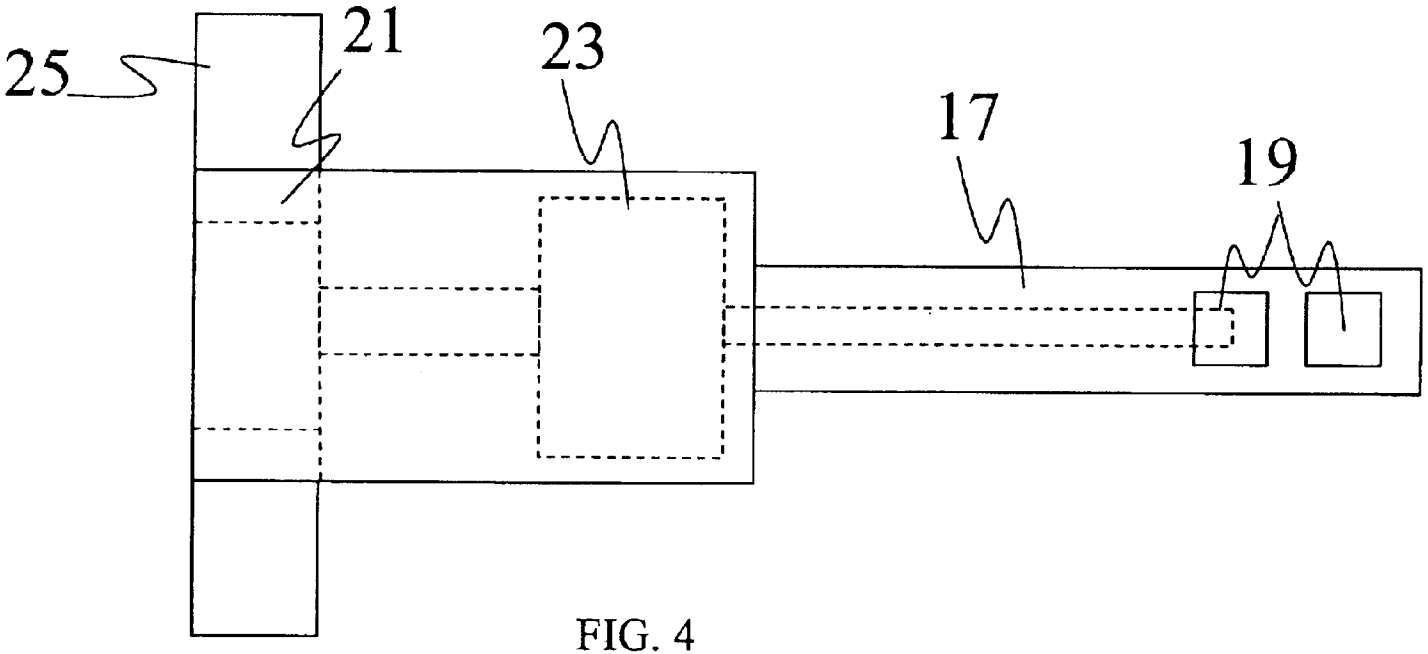
FIG. 4 is a top view of a shunt cantilever aspect the device of the present invention.

A top view of a cantilever arm aspect of the present invention is presented in FIG. 4. This aspect includes a cantilever arm 17 constructed as a rectangular lever made of an electrically neutral material such as silicon nitride, with an anchor end 19, a contact end 21, and an actuation portion 23. The contact end 21 faces and directly opposes the transmission line 25 that is embedded in the substrate 27 (see FIGS. 5, 6).

Figure 5:
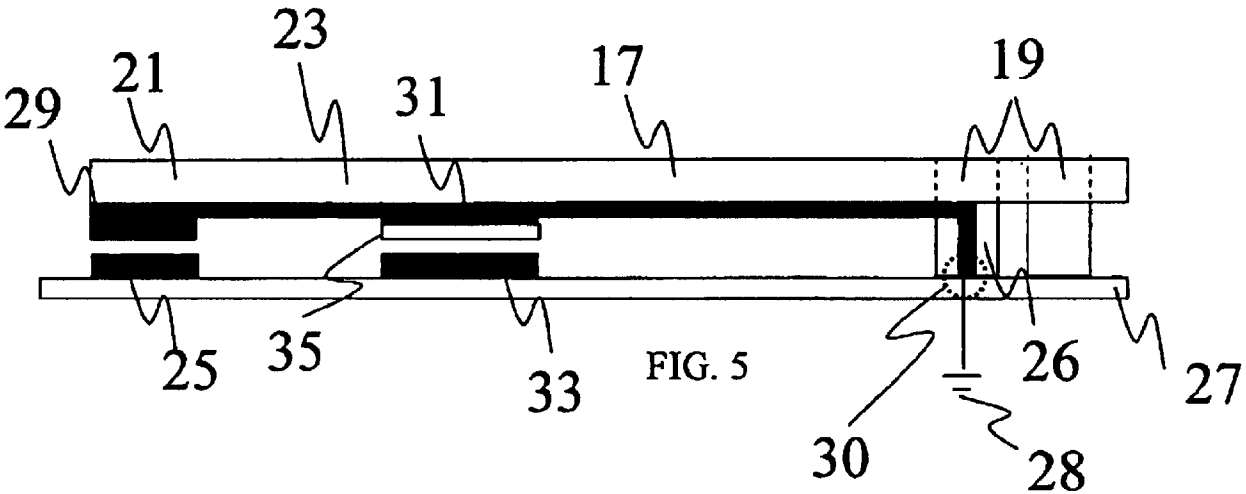
FIG. 5 is a side view of a shunt cantilever aspect the device of the present invention in the "open" position.

As demonstrated in FIG. 5, the anchor end 19 of the cantilever arm 17 is mechanically attached to the top of an anchor 26, with the bottom of the anchor 26 being mechanically attached to the substrate 27 and electrically connected to ground 28, via a ground contact 30. A contact strip 29 is mechanically attached to the underside contact end 21 of the cantilever arm 17 such that it faces, and is aligned along, the length of the transmission line 25. The actuator pads 31 and 33 are formed of an electrically conductive material, with the top actuator pad 31 mechanically attached to the underside of the cantilever arm 17 and situated such that it is in mechanical and electrical contact with the anchor 26 and the contact stripe 29. A very thin layer of insulating material 35 such as silicon nitride lies under the top actuator pad 31 and between the top and bottom actuator pads 31 and 33, respectively, to prevent electrical contact therebetween. The bottom actuator pad 33 is situated directly beneath the top actuator pad 31 and is mechanically attached to the substrate 27. When the device is in the "open" position, that is, when there has not been a signal applied to the bottom actuator pad 33, there exists an air gap between the actuation pads 31 and 33, and between the contact stripe 29 and the transmission line 25. A DC bias may be applied to the actuator pad 33 in order to change the signal required on the transmission line 25 to activate the device. This provides a means for threshold adjustment. Rather than, or in addition to, a DC bias, a material such as an electret may be used to build-in some static charge on pad 33 also reducing the required signal on the transmission line 25 for activation.

Figure 6:
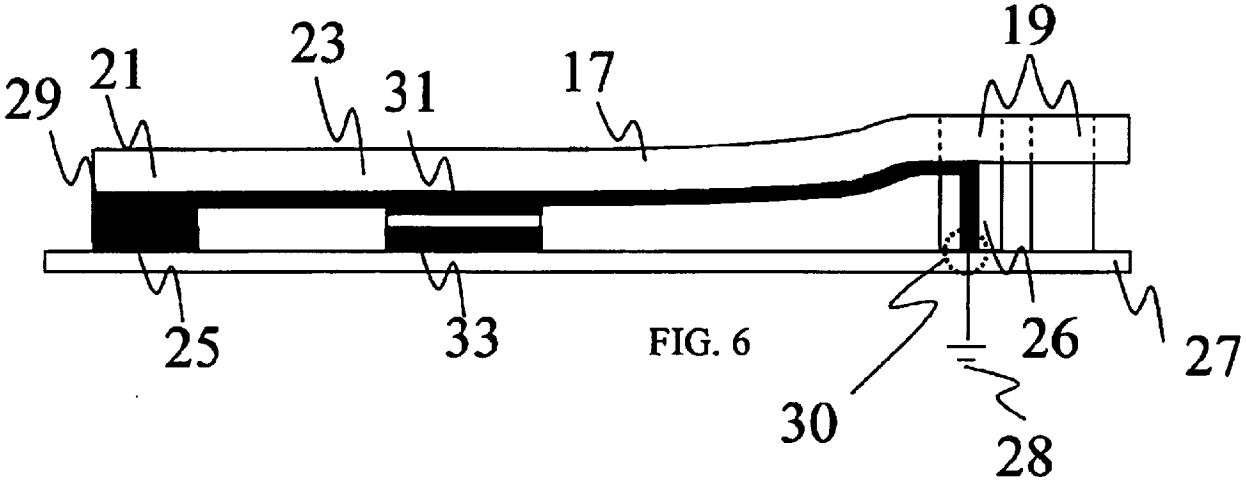
FIG. 6 is a side view of a shunt cantilever aspect the device of the present invention in the "closed" position.

FIG. 6 shows the operation of the device when a signal is applied to the bottom actuation pad 33. In this scenario, an electrostatic force is created such that the top actuation pad 31 is drawn toward the bottom actuation pad 33, resulting in contact between the contact stripe 29 and the transmission line 25.

Figure 7:
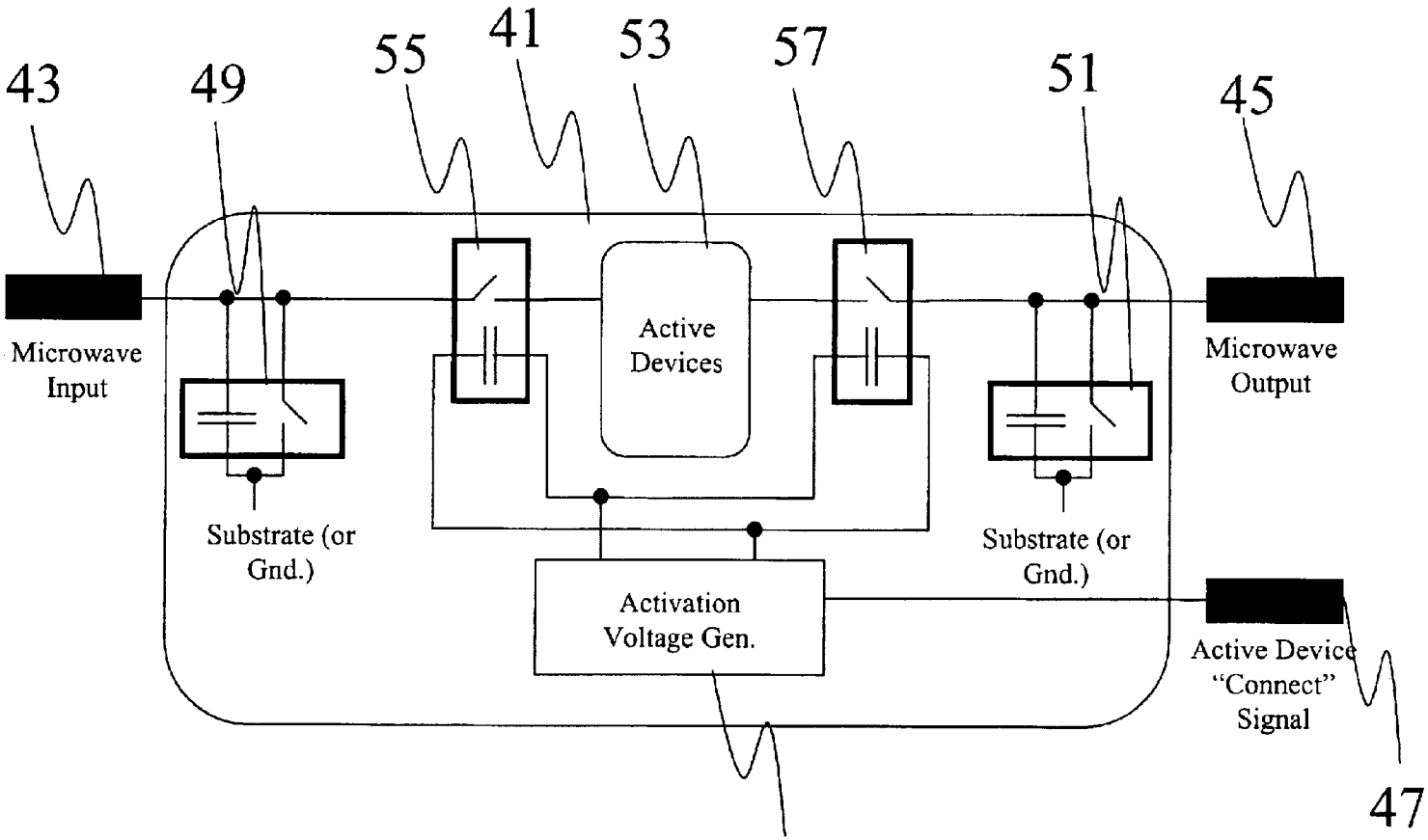
FIG. 7 shows a typical implementation of devices in accordance with the present invention as used in a MMIC.

FIG. 7 shows the application of the preferred aspect of the ESD protection device in the context of a simple system. The system 41, has a microwave input 43 with a microwave output 45 and an active device "connect" signal 47 serving as a system 41, turn-on signal. In the input protection aspect 49, the ESD protection device protects the active devices 53 from unwanted signals from the microwave input 43 by shorting the unwanted signals to ground. In the output protection aspect 51 the ESD protection device protects the output active devices in 53. The control signals for the input and output protection aspects may come from a number of sources, dependent primarily upon design goals. Another aspect of the ESD protection device is its use as a series"on/off" switch for active devices and their outputs. Series on/off switches 55 and 57 are configured to allow the passage of a signal from the microwave input 43 to the active devices 53, and from the active devices 53 to the microwave output 45, respectively, upon activation of 47 to the "on" position. Activation of the on/off switches takes place via an activation voltage generator 59 that, in turn, is activated upon receipt of an active device "connect" signal 47 from a source outside the system 41.

Figure 8:
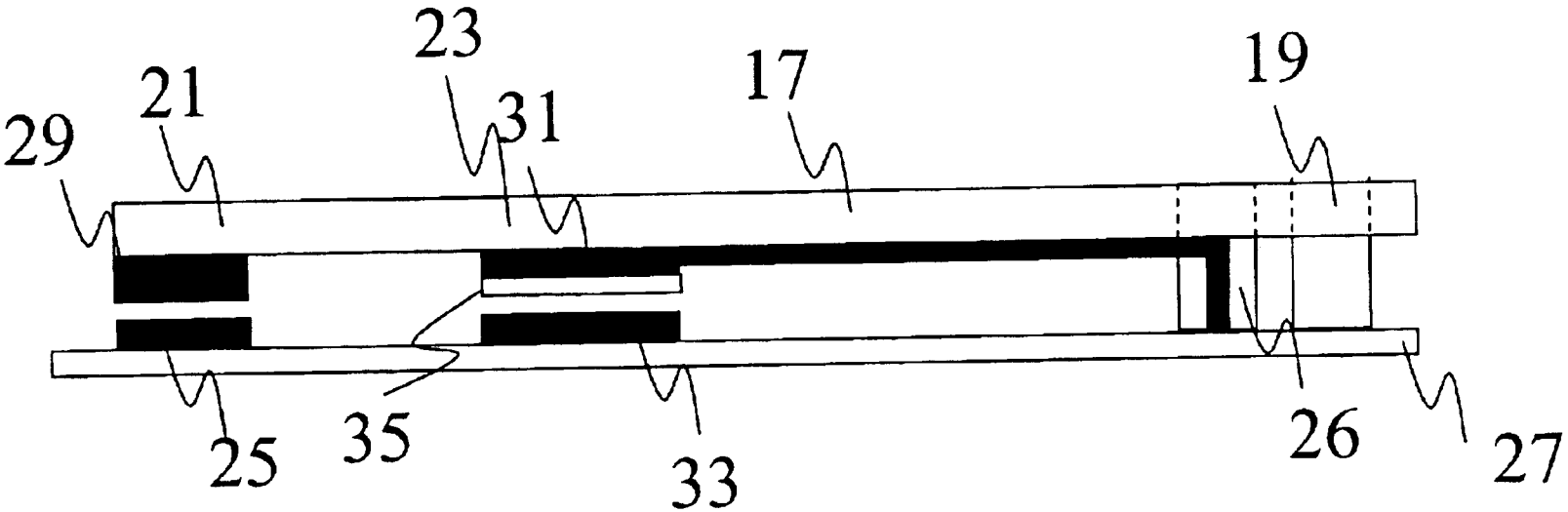
FIG. 8 shows a side view of the series cantilever aspect used as an ESD protection switch in the "open" position.

FIG. 8 shows the preferred aspect of the series ESD protection switch with elements 17, 19, 21, 23, 25, 26, 27, 29, 31, 33, and 35 analogous to those of FIGS. 5 and 6, except that in this aspect, the activation pad 31 is not connected to the contact 21. Thus the activation signal is distinct from the microwave transmission lines.

What is claimed is:

1. A power regulator including:

d. a substrate having a side with at least one ground contact of an electrically conductive material formed thereon, and a substantially planar transmission line of an electrically conductive material formed thereon;

e. a substantially elongated strip of electrically conductive material electrically and mechanically connected to the at least one ground contact and positioned so that a portion of the substantially elongated strip is adjacent to the substantially planar transmission line and so that a gap is formed therebetween, such that when an undesirable signal is present in the substantially planar transmission line, a resultant force is created, causing the substantially elongated strip to flex toward the transmission line, physically and electrically contacting the transmission line and thus diverting the undesirable signal to ground by passing the signal through the substantially elongated strip to the at least one ground contact; and f. the power regulator used for electrostatic discharge protection.

2. A power regulator including:

a. a substrate having a side with at least one ground contact of an electrically conductive material formed thereon, and a substantially planar transmission line of an electrically conductive material formed thereon;

b. a substantially elongated strip of electrically conductive material electrically and mechanically connected to the at least one ground contact and positioned so that a portion of the substantially elongated strip is adjacent to the substantially planar transmission line and so that a gap is formed therebetween, such that when an undesirable signal is present in the substantially planar transmission line, a resultant force is created, causing the substantially elongated strip to flex toward the transmission line, physically and electrically contacting the transmission line and thus diverting the undesirable signal to ground by passing the signal through the substantially elongated strip to the at least one ground contact; and c. further including a plurality of power regulators.

3. A power regulator including:

a. a substrate having a side with at least one ground contact of an electrically conductive material formed thereon, a substantially planar transmission line of an electrically conductive material formed thereon, and an actuator pad formed thereon;

b. a substantially elongated strip of material including at least one layer of electrically conductive material, said elongated strip of material formed as a cantilever arm having a first end and a second end, with the first end mechanically attached to the substrate with the electrically conductive material electrically connected to the at least one ground contact, and the second end of the cantilever arm including an electrically conductive contact pad formed on the at least one layer of electrically conductive material and positioned adjacent to the substantially planar transmission line so that a gap is formed therebetween; and c. the cantilever arm further including an insulating layer formed such that it resides between the first end and the second end, and resides adjacent to the actuator pad on the substrate, such that when a signal is passed to the actuator pad, the electrically conductive contact pad is forced into contact with the substantially planar transmission line and such that the insulating layer on the cantilever arm provides means to maintain a force sufficient to maintain the contact during the application of a bias to the actuation pad.

4. A power regulator as set forth in claim 3, used for electrostatic discharge protection.

5. A power regulator as set forth in claim 3, used for power limitation.

6. A power regulator system, including a plurality of power regulators as set forth in claim 3.

7. A power regulator as set forth in claim 3 wherein a DC bias is applied to the actuator pad in order to affect the power level required along the substantially planar transmission line to flex the cantilever arm such that the electrically conductive contact pad electrically contacts the substantially planar transmission line.

8. A power regulator as set forth in claim 3, wherein a portion of the actuator pads is formed of an electret material such that the power level required for flexion of the cantilever arm is affected by the built-in charge of the electret.

9. A power regulator as set forth in claim 8, wherein the electret material is selected with a built-in charge of strength sufficient that after the cantilever arm has flexed such that the electrically conductive contact pad has electrically contacted the substantially planar transmission line, the cantilever arm will remain flexed such that the electrically conductive contact pad electrically contacts the substantially planar transmission line.

* * * * *